US005607074A

United States Patent [19]

De Gennaro

[11] Patent Number: 5,607,074

[45] Date of Patent: Mar. 4, 1997

[54] BABY BOTTLE WITH PRESSURE RELIEF VALVE

[76] Inventor: Sergio K. De Gennaro, 59 Hyacinth Rd., Levittown, N.Y. 11756

[21] Appl. No.: 542,181

[22] Filed: Oct. 12, 1995

[51] Int. Cl.[6] ..... A61J 9/04

[52] U.S. Cl. ..... 215/11.5; 220/89.1; 220/DIG. 27

[58] Field of Search ..... 215/11.1, 11.5; 220/361, 367, 373, DIG. 27, 89.1; 137/542; 222/488, 490

[56] References Cited

U.S. PATENT DOCUMENTS

| | | | |
|---|---|---|---|
| 297,174 | 4/1884 | Seymour . | |
| 1,732,126 | 10/1929 | Gardner . | |
| 2,084,099 | 6/1937 | Maccoy | 215/11.5 |
| 3,768,682 | 10/1973 | Meyers e tal. | 215/11.5 |
| 3,768,683 | 10/1973 | Van Den Bosch . | |
| 4,165,816 | 8/1979 | Tupper | 220/373 X |
| 4,401,224 | 8/1983 | Alonso | 215/11.1 |
| 4,730,744 | 3/1988 | Vincinguerra | 215/11.5 |
| 4,828,126 | 5/1989 | Vincinguerra | 215/11.5 |
| 4,928,836 | 5/1990 | Wu et al. | 215/11.5 |

FOREIGN PATENT DOCUMENTS

| | | | |
|---|---|---|---|
| 2944279 | 5/1981 | Germany | 215/11.5 |

*Primary Examiner*—Allan N. Shoap
*Assistant Examiner*—Christopher J. McDonald
*Attorney, Agent, or Firm*—Norbert P. Holler; Gottlieb, Rackman & Reisman, P.C.

[57] ABSTRACT

A baby bottle with two open ends and two end caps for securing a nipple and a pressure relief valve assembly to the ends of the bottle. The valve assembly includes an outwardly flanged inverted cup-shaped valve seat member having a base provided with an axial bore which extends from the inner to the outer face of the base and accommodates a reciprocally axially movable valve stem. The valve stem at one end thereof defines a valve head normally received in the valve seat-defining end region of the bore under the biasing force of a spring interposed between the inner face of the base and a snap-on disc carried by the valve stem. The transverse web of the bottom end cap is continuous over the full width of the cap and has a number of small openings distributed over its mid-region and, when the cap is secured to the bottle, engages the flange of the valve seat member and forces a sealing ring supported by that flange against the proximate end edge of the bottle to sealingly secure the valve assembly to the bottle. The bottom end cap serves to permit air to enter the bottle when the valve opens as the baby sucks on the nipple, and also to prevent small, easily swallowed parts of the valve assembly from inadvertently falling out of the bottle and coming into the reach of the baby.

4 Claims, 3 Drawing Sheets

BABY BOTTLE WITH PRESSURE RELIEF VALVE

FIELD OF THE INVENTION

This invention relates to a baby bottle, and more particularly to a baby bottle which is provided with a pressure relief valve at its bottom end.

BACKGROUND OF THE INVENTION

As is well known, when a baby drinks milk, formula, water or juice from a baby bottle, the baby's sucking action tends to create a vacuum in the bottle, leading to the collapse of the nipple and frequently to the baby being unable to draw more liquid from the bottle. The baby's exertions to keep drinking then become very stressful and also cause the baby to draw much air into its stomach, with adverse results in terms of pain and sleeplessness for both the baby and its parents that any parent of a colicky baby can easily understand.

In an attempt to overcome these problems, baby bottles have heretofore been proposed which include valves at their bottom ends for the express purpose of relieving the vacuum in the bottle either manually or automatically while the baby is drinking from the bottle. Representative constructions of such bottles are shown in U.S. Pat. Nos. 1,732,126 (Gardner); 2,084,099 (Maccoy); 3,768,683 (Van Den Bosch); 4,730,744 and 4,828,126 (Vincinguerra); and 4,928,836 (Wu et al.). For one reason or another, however, these bottles have not found favor in the marketplace, most likely because the valves are difficult and time-consuming to disassemble and clean and thus place an extra strain on the usually already limited time of the baby's mother, and because the valves tend to leak. Still another reason may be that the valves pose a hidden danger to a baby in that the relatively small components of such a valve, should they become inadvertently or accidentally disassembled and fall into the baby's crib or carriage, could be easily taken by the baby into its mouth and swallowed, with potentially disastrous consequences.

BRIEF DESCRIPTION OF THE INVENTION

The main object of the present invention, therefore, is to provide a pressure relief valve-equipped baby bottle which avoids the drawbacks and disadvantages of the known valved baby bottles and which is rendered substantially child-proof by means of a special construction designed on the one hand to minimize the risk of the pressure relief valve assembly being disassembled by children and on the other hand to prevent small, easily swallowable parts of the valve assembly from inadvertently falling out of the bottle and coming into the reach of the baby.

Generally speaking, the objectives of the invention are achieved by means of a baby bottle equipped with a pressure relief valve assembly as aforesaid, wherein the bottle has a body with two open ends, a first end cap for securing a nipple to the top end of the bottle, and a second end cap for securing the pressure relief valve assembly to the bottom end of the bottle. The pressure relief valve assembly includes a valve stem having a valve head at one of its ends and a small enlargement or bead at its other end, an associated valve seat member having a bore extending therethrough which freely reciprocally movably accommodates the valve stem and defines at one end region of the bore a valve seat portion for the valve head, an annular disc which is sufficiently flexible to be snap-fitted onto the valve stem over the small enlargement of the latter, and a small compression spring surrounding the end region of the valve stem proximate to the small enlargement thereof, the spring being interposed between and bearing against both the annular disc and the proximate face of the valve seat member for biasing the valve stem in a sense tending to dispose the valve head in sealing engagement with the valve seat. The end cap for securing the pressure relief valve assembly to the bottle has, in addition to the usual peripheral wall portion formed with means (screw threads, camming ribs, or the like) by which the cap can be fastened to the bottle, a transverse web which is continuous over the full width of the cap except for having a plurality of discrete small air openings provided in its mid-region. The cap and the pressure relief valve assembly are cooperably designed to enable the latter to be frictionally fitted to and retained by the cap, thereby to permit the end cap and the pressure relief valve assembly to be jointly manipulated while being connected to and disconnected from the bottle. The transverse web of the end cap serves the dual function of permitting air to be drawn into the bottle via the open pressure relief valve and of preventing small parts of the valve assembly from falling out of the bottle and becoming accessible to the baby.

All parts of the pressure relief valve assembly, except for the spring, which will normally be made of stainless steel, are preferably molded of suitable non-toxic synthetic plastic materials such as polyethylene, polypropylene, polyvinyl chloride, and the like. Within this context, however, the valve head and the valve seat-defining portion of the valve bore wall may optionally be made so as to have different densities or hardnesses (e.g., in the form of high and low density polyehtylene or the like), so that the surface of one of them will be able to conform to surface irregularities in the other when the two surfaces are in sealing interengagement with each other. Such an arrangement will provide an enhanced resistance to leakage of the bottle contents past the valve when the latter is in its closed state.

BRIEF DESCRIPTION OF THE DRAWING

The foregoing and other objects, characteristics and advantages of the present invention will be more clearly understood from the following detailed description of a preferred embodiment thereof when read in conjunction with the accompanying drawings, in which.

DETAILED DESCRIPTION OF THE INVENTION

Figure 1:
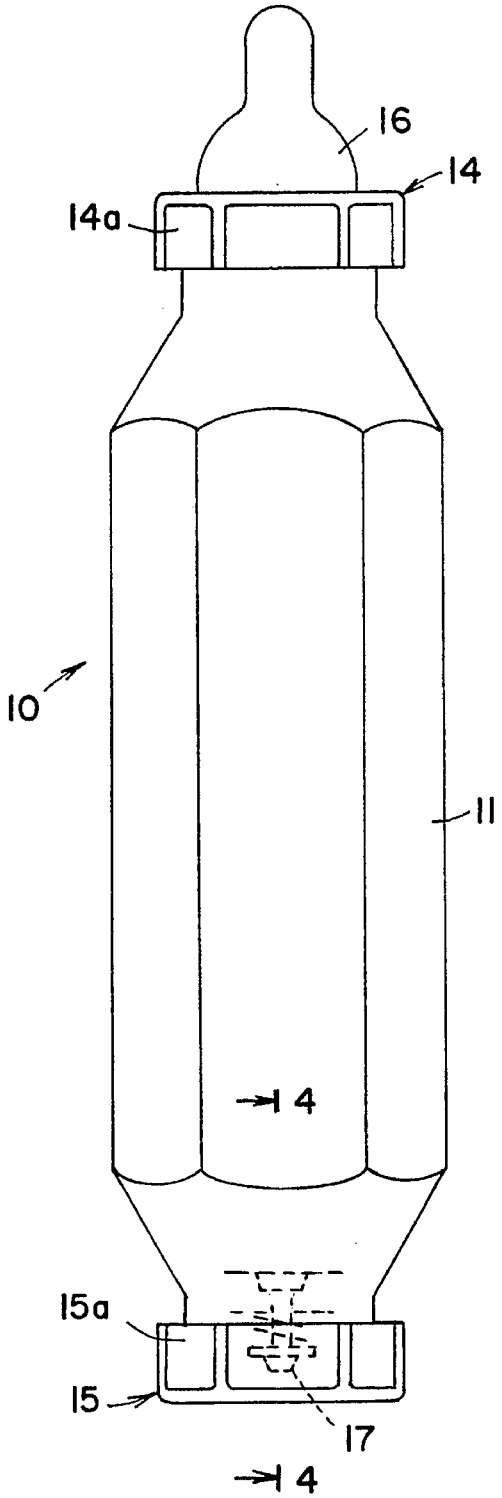
FIG. 1 is a side elevational view of a baby bottle according to the present invention which has a body with two externally threaded open ends, one for receiving a screw cap to secure the conventional nipple to the top end of the body of the bottle, and the other for receiving a screw cap to secure a pressure relief valve assembly to the bottom end of the body of the bottle.
Figure 3:
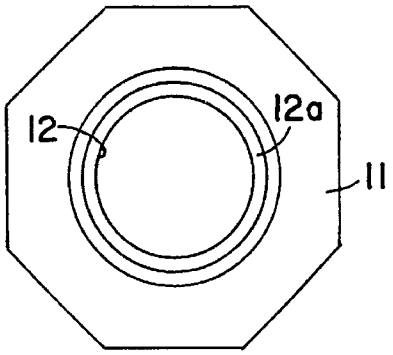
FIG. 3 is an endwise view of the bottle body shown in FIG. 2.
Figure 2:
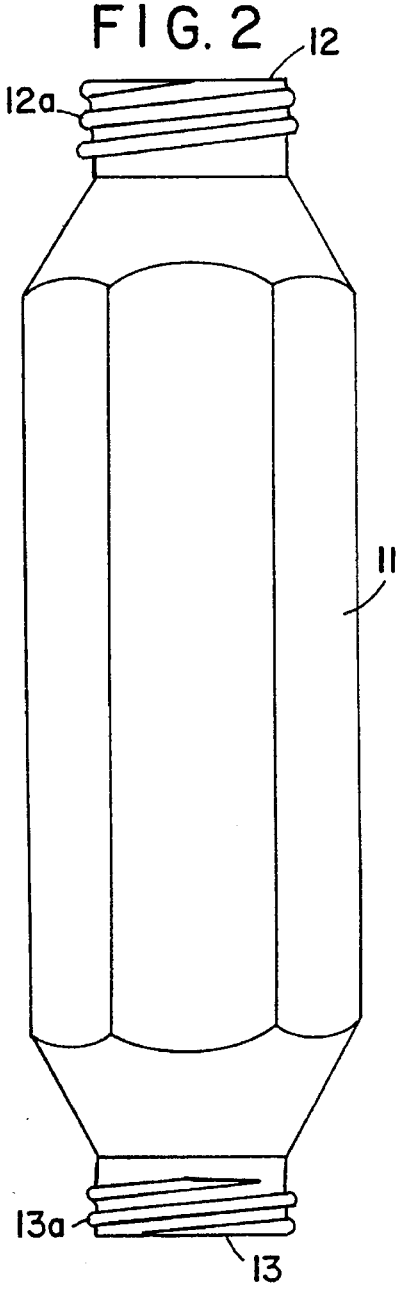
FIG. 2 is a side elevational view of the body of the bottle without the two screw caps attached thereto.

Referring now to the drawings in greater detail, the baby bottle 10 according to the present invention (see FIG. 1) has a body 11 (see also FIGS. 2 and 3) which is made of any suitable material such as glass or a non-toxic, and if desired also reinforced, synthetic plastic and has identical open ends 12 and 13. In the illustrated embodiment, both end regions of the body 11 are externally threaded at 12*a* and 13*a*, respectively, to enable a pair of screw caps 14 and 15 to be secured thereto. The structure and configuration of the screw cap 14 are entirely conventional, in that the cap has an internally threaded peripheral wall portion 14*a* and an annular transverse web (not shown) which is discontinuous over the width of the cap by virtue of being provided with a large central opening (not shown) to accommodate a conventional nipple 16. The screw cap 14 thus serves in the usual manner to fasten the nipple 16 to and across the top end 12 of the bottle body 11. The screw cap 15, on the other hand, is of somewhat modified construction, in that it has, in addition to the standard internally threaded peripheral wall portion 15*a*, a transverse web 15*b* (see FIGS. 4–6) which is continuous over the full width of the cap and is provided in its mid-region with a plurality of discrete small openings 15*c*. Some of the functions of this transverse web will become clear as the description proceeds. Suffice it to say at this point that the screw cap 15 serves to fasten a pressure relief valve assembly 17 to the bottom end 13 of the bottle body 11 so as to dispose the valve assembly operatively within the confines of the bottom end region of the bottle body.

Figure 4:
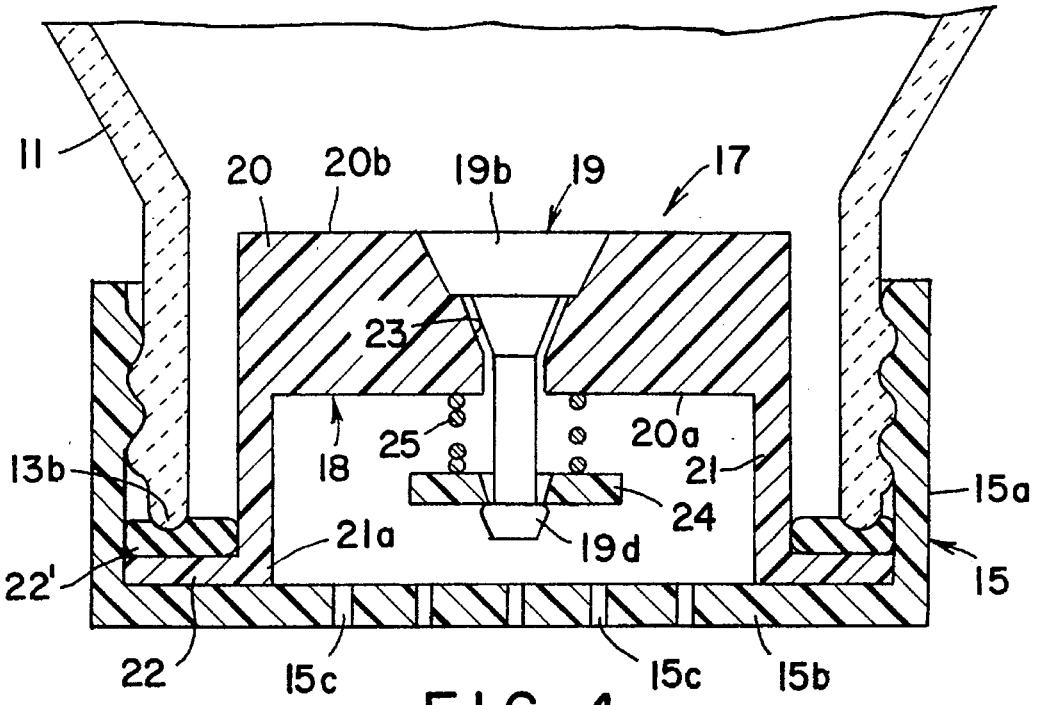
FIG. 4 is a fragmentary sectional view, taken along the line 4—4 in FIG. 1, of the bottom end region of the bottle of the present invention, the view being drawn to a greatly enlarged scale and illustrating the details of the pressure relief valve assembly with the valve in its closed position.
Figure 5:
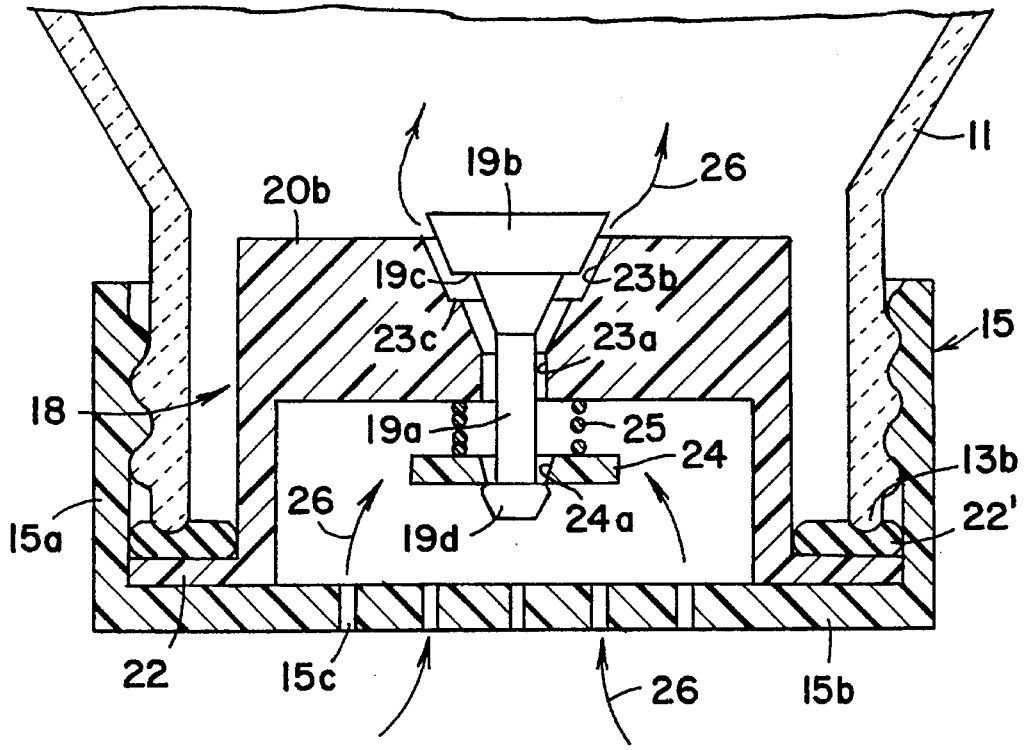
FIG. 5 is a view similar to FIG. 4 but shows the valve in its open position.
Figure 6:
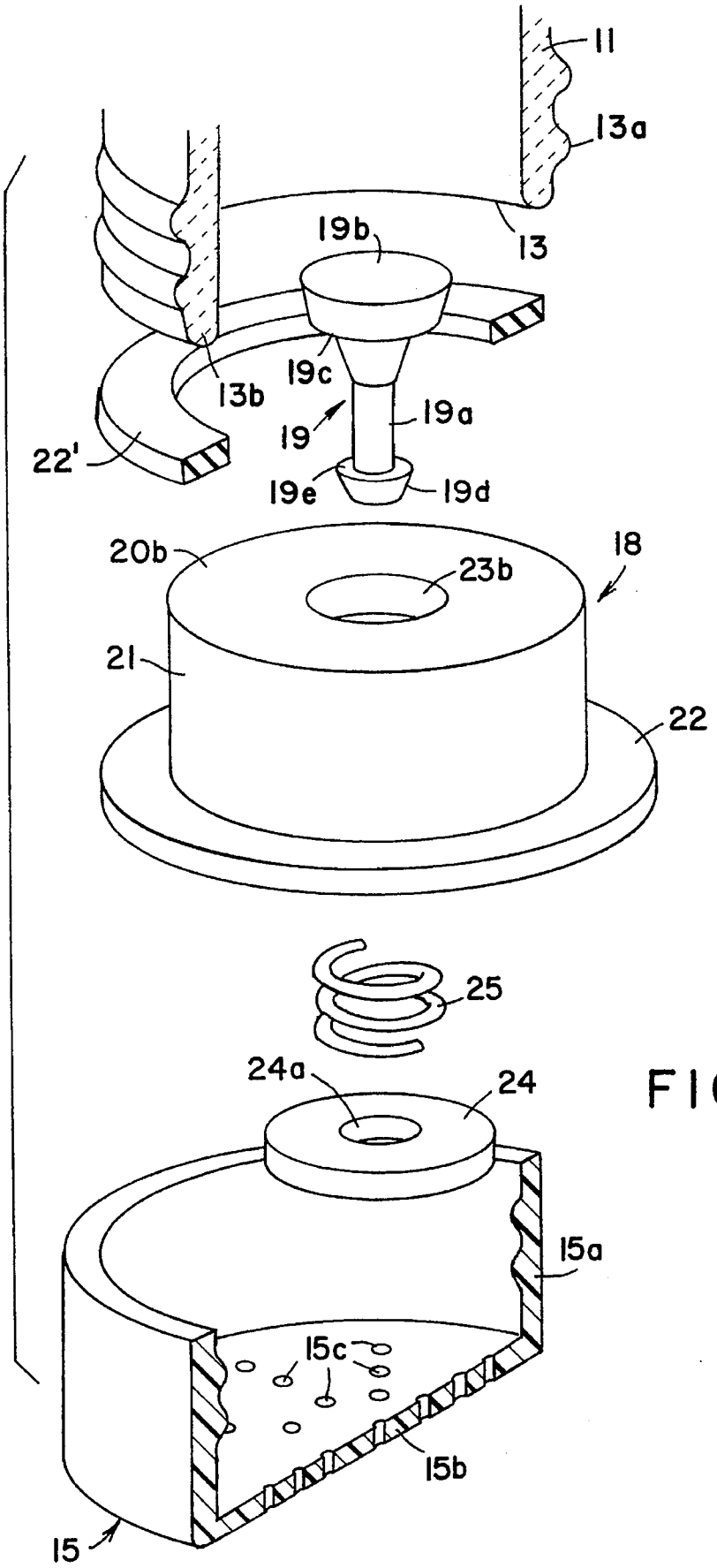
FIG. 6 is an exploded, perspective view, partly in section, of the bottom end region of the bottle shown in FIGS. 4 and 5.

As best shown in FIGS. 4–6, the pressure relief valve assembly 17 includes an inverted cup-shaped valve seat member 18 and an associated valve member 19. The member 18 consists of a base portion 20 having an inner face 20*a* and an outer face 20*b*, and a peripheral skirt portion 21 surrounding the inner face of the base portion and extending from the latter in a direction away from the outer face of the base to an open extremity 21*a*, with a laterally outwardly directed circumferential flange 22 extending from the open extremity 21*a* of the skirt portion. The outer diameter of the flange 22 is slightly smaller than the inner diameter of, but fits fairly closely into, the internally threaded peripheral wall portion 15*a* of the screw cap 15, the arrangement being such that the flange can be forcibly fitted into and frictionally retained in the screw cap 15 substantially coaxially therewith. As a result, the screw cap 15 and the pressure relief valve assembly in its entirety (some details of which still remain to be described) can be fitted to each other apart from the bottle and in such a condition can be jointly connected to and disconnected from the bottom end region of the bottle body 11. It will furthermore be apparent that when the valve seat member 18 (along with the remainder of the pressure relief valve assembly 17) is axially positioned in the screw cap 15 and the latter is secured to the bottom end region of the bottle body 11, the dimensioning of the flange 22 ensures that it overlies the boundary edge 13*b* of the bottom opening 13 of the bottle and serves to force a sealing ring 22' against the boundary edge 13*b*.

The member 18 is further provided with an axial through bore 23 within the base portion 20. In the illustrated embodiment, the bore 23 has a partly cylindrical and partly flaring or frusto-conical main section 23*a* open at the inner face 20*a* of the base and an enlarged flaring or generally frusto-conically shaped valve seat-defining end section 23*b* open at the outer face 20*b* of the base. The bore section 23*b* adjoins the flaring part of the main section 23 of the bore at a transverse annular ledge 23*c*. Correspondingly, the valve member 19 in the illustrated embodiment has a partly cylindrical and partly flaring or frusto-conical stem portion 19*a*, and an enlarged generally frusto-conically shaped valve head portion 19*b* at one end of the stem portion 19*a*, the valve head portion adjoining the flaring section of the valve stem portion along an annular shoulder 19*c*. Both the valve seat member 18 and the valve member 19 are preferably injection molded of any suitable non-toxic synthetic plastic such as, for example, polyethylene, polypropylene, polyvinyl chloride, or the like, and both the valve member 19 and the bore 23 are so dimensioned and configured that, when the valve is in its closed state (see FIG. 4), the valve head 19*b* is in sealingly flush circumferential surface contact with the surrounding wall section 23*b* of the bore 23, the annular shoulder 19*c* of the valve head is in sealingly flush circumferential surface contact with the annular ledge 23*c* of the bore, and the region of the stem portion 19*a* of the valve member located within the main section 23*a* of the bore is spaced from the surrounding wall sections of the bore. As previously indicated, at least the valve head and the valve seat may be made so as to have different densities or hardnesses, which will enable the contact surface of either the valve head or the valve seat to conform to surface irregularities in the other when the two surfaces are in sealing interengagement with each other upon closing of the valve and will enhance the ability of the valve to inhibit the contents of the bottle from leaking through the valve.

The valve member 19 also is provided at the other end of the stem portion 19*a* with a somewhat less enlarged portion 19*d* defining a bead the shoulder 19*e* of which is directed toward the valve head 19*b*, for the purpose of establishing a support location for an annular disc 24 through the central opening 24*a* of which the cylindrical section of the valve stem portion 19*a* extends. The maximum diameter of the small enlargement or bead 19*d* of the valve member 19 must, of course, be smaller than the minimum diameter of the bore 23 to permit the members 18 and 19 to be assembled with and disassembled from each other. The annular disc 24 is preferably injection molded of the same type of synthetic plastic material as the valve member 19, and the disc is stiff and form-retaining but sufficiently yielding to enable it to be forcibly snapped onto and off the valve stem portion 19*a* over the small enlargement 19*d* thereof when the disc and the valve stem are in the respective orientations thereof shown in FIGS. 4 and 5. In the assembled state of the valve seat member 18, the valve member 19 and the annular disc 24, a small preferably stainless steel compression spring 25 is arranged in surrounding relation to the cylindrical section of the valve stem 19*a* between the base 20 of the member 18 and the annular disc 24, the opposite end turns of the spring bearing against the inner face 20*a* of the base of the valve seat member and the confronting face of the annular disc or abutment member 24 supported by the valve stem 19*a* so as to normally bias the valve member 19 into its closed position shown in FIG. 4.

It should be noted, in this regard, that although both the bead 19*d* of the valve member 19 and the opening 24*a* of the disc 24 are shown as having a generally frusto-conical configuration, this is not essential; for example, the bead 19*d* could have an oval or spherical or otherwise peripherally rounded shape, and the opening 24*a* could have a cylindrical form. The indispensable requirement is that the minimum diameter of the opening 24*a* must be only slightly smaller than the maximum diameter of the bead 19*d*, so that the disc 24 can be easily snapped onto and off the valve stem 19*a* but, when supported by the latter in the full valve assembly 17, will be retained in place on the valve stem by the bead 19*d* even when subjected to the biasing force of the spring 25.

The manner in which the goals of the present invention are achieved will be readily apparent from the foregoing description. In use, when the baby sucks on the nipple 16, the resultant lowered air pressure or partial vacuum created within the bottle 10 will permit the ambient atmospheric air pressure, acting through the clearance or space between the valve stem portion 19*a* and the bore section 23*a*, to open the normally closed valve (FIG. 4) against the biasing force of the spring 25. This will enable air to enter the bottle, as indicated by the arrows 26 in FIG. 5, to return the air pressure in the bottle to atmospheric. Once that equilibrium has been reached, the spring will act to close the valve until continued sucking by the baby again causes the pressure within the bottle to fall and establish a pressure differential sufficient to overcome the biasing force of the spring. When the baby is finished drinking and the bottle is to be cleaned, the screw caps 14 and 15 are, of course, unscrewed from the bottle, with the removal of the screw cap 15 simultaneously extracting the pressure relief valve assembly as a unit from the bottle. If the valve assembly is then to be disassembled for cleaning, it can first be extracted from the screw cap 15 by dislodging the member 18 out of the cap either by inserting a finger into the space between the member 18 and the wall portion 15*a* of the cap or, if that space is not wide enough for a finger, by inserting a part of a utensil (the handle of a spoon or fork, the blade of a knife, a screw driver, etc.) into the space. The valve assembly 17 can, of course, also be cleaned without being separated from the screw cap 15 and disassembled, by simply inserting a pin or other thin rod-like member (e.g., a corn holder) into the cap through one of the air openings 15*c* and using it to push the valve member 19 into its open state while submerging the cap in water.

The present invention provides yet another advantage, in that the pressure relief valve assembly 17 is essentially child-proof. Thus, young children will find it next to impossible to disconnect the pressure relief valve assembly 17 from the end cap 15 even if they were able to separate the cap and valve assembly unit from the bottle, and they will find it equally difficult to disassemble the valve assembly even if they were able somehow to extract it from the end cap. Consequently, even if a parent or adult baby sitter were to leave a baby drinking from a bottle alone in the company of a small child (for example, a sibling or a playmate of a sibling of the baby) while turning away or going out of the room to attend to another task, the risk of that child being able not only to take the bottom end cap off the bottle but to separate the pressure relief valve assembly from the cap and then to disassemble it into its component parts and then to leave those parts where the baby could get at and possibly swallow one is so small as to be negligible for all practical purposes.

It will be understood that the foregoing description of a preferred embodiment of the present invention is for purposes of illustration only, and that the various structural and operational features herein disclosed are susceptible to a number of modifications and changes none of which entails any departure from the spirit and scope of the present invention as defined in the hereto appended claims. Merely by way of example, the means for securing the end caps 14 and 15 to the bottle need not be screw threads on the respective interengageable surfaces but could be camming ribs or flanges such as are frequently used for "twist-on/twist-off" types of closures, or even a tight friction fit.

I claim:

1. A baby bottle comprising:

a bottle body having first and second open ends;

a nipple located over said first end of said body of said bottle, and a first end cap releasably attached to said first end of said body and securing said nipple to said first end of said body; and a pressure relief valve assembly located within said body adjacent said second end of the latter, and a second end cap releasably attached to said second end of said body and securing said pressure relief valve assembly to said second end of said body, said second end cap having a transverse web which is continuous over the full width of said second end cap and is provided with a plurality of discrete small openings in a mid-region of said transverse web establishing communication between the surrounding atmosphere and the interior of said second end cap;

said pressure relief valve assembly including (a) an inverted cup-shaped valve seat member having (i) a base provided with inner and outer faces, (ii) a peripheral skirt portion surrounding said inner face of said base and extending therefrom in a direction away from said outer face to an open extremity, (iii) a laterally outwardly directed circumferential flange extending from said open extremity of said skirt portion at a small distance from and in overlying relation to a circumferential boundary edge of said second open end of said body of said bottle and bearing a sealing ring in surrounding relation to said skirt portion between said flange and said boundary edge of said second open end of said body, and (iv) an axial through bore which extends from said inner face to said outer face of said base and has a main section open at said inner face of said base and an enlarged end section open at said outer face of said base, said enlarged end section being configured to define a valve seat;

(b) a reciprocally axially movable valve stem received within said bore, said valve stem having (i) a first end region thereof projecting from said main section of said bore at said inner face of said base and terminating within the confines of said skirt portion in a small lateral enlargement, and (ii) a second end region of an enlarged configuration corresponding to that of said enlarged end section of said bore so as to constitute a valve head sealingly engageable with said valve seat;

(c) a stiff but flexibly deformable annular disc mounted axially on said first end region of said valve stem and retained thereon by said small enlargement of said valve stem so as to constitute an abutment member, said annular disc having a central hole therein which is slightly smaller than said small enlargement of said valve stem so as to enable said annular disc to be snap-fitted over said small enlargement onto said valve stem; and (d) a compression spring interposed between and bearing at opposite ends thereof against said inner face of said base and said annular disc, respectively, said spring being arranged in surrounding relation to said first end region of said valve stem and biasing the latter in a direction tending to dispose said valve head in a closed sealing position against said valve seat;

whereby when said second end cap is secured to said second end of said body of said bottle, said transverse web of said second end cap at a peripheral region thereof engages said flange of said valve seat member and forces said sealing ring against said second end of said body to sealingly secure said valve assembly to said body, and said transverse web serves to permit ambient air pressure to displace said valve head against the biasing force of said compression spring and away from said valve seat to an open position as a baby sucks on said nipple and reduces the air pressure within said bottle, and said transverse web serves also to prevent small, easily swallowable parts of said valve assembly from inadvertently falling out of said bottle and coming into the reach of the baby.

2. A baby bottle as claimed in claim 1, wherein said base of said valve seat member and said valve head of said valve member are made of synthetic plastic material, and the material of which said base of said valve seat member is made has a different density than the material of which said valve head is made.

3. A baby bottle as claimed in claim 1, wherein said second end cap has a peripheral coaxial wall portion with an inner diameter, and said flange of said valve seat member has an outer diameter which is slightly smaller than said inner diameter of said wall portion to enable said flange of said valve seat member to be forced into and frictionally retained in said second end cap, thereby to permit said second end cap and said pressure relief valve assembly in its entirety to be jointly connected to and disconnected from said body of said bottle.

4. A baby bottle as claimed in claim 1, wherein said base of said valve seat member and said valve head of said valve member are made of synthetic plastic material, and the material of which said base of said valve seat member is made has a different hardness than the material of which said valve head is made.

* * * * *